United States Patent [19]

Potter

[11] Patent Number: 4,954,137

[45] Date of Patent: Sep. 4, 1990

[54] INHIBITION OF SULFIDE INCLUSION IN SLAG

[75] Inventor: Michael W. Potter, Sugar Land, Tex.

[73] Assignee: Shell Oil Company, Houston, Tex.

[21] Appl. No.: 452,438

[22] Filed: Dec. 19, 1989

[51] Int. Cl.[5] ..... C10J 3/00; C10J 3/46

[52] U.S. Cl. ..... 48/210; 48/206; 48/DIG. 2; 252/373

[58] Field of Search ..... 48/197 R, 203, 206, 48/210, DIG. 2, 69; 252/373

[56] References Cited

U.S. PATENT DOCUMENTS

| | | | |
|---|---|---|---|
| 2,716,598 | 8/1955 | Moses | 48/DIG. 2 |
| 2,971,830 | 2/1961 | Kawai et al. | 48/206 |
| 4,071,329 | 1/1978 | Eales | 48/DIG. 2 |
| 4,760,667 | 8/1988 | Eckstein et al. | 48/DIG. 2 |
| 4,806,131 | 2/1989 | Morihara et al. | 48/210 |

*Primary Examiner*—Peter Kratz

*Attorney, Agent, or Firm*—Albert J. Adamcik

[57] ABSTRACT

A process for the gasification of coal is described which comprises partially combusting particulate coal in a gasification reactor comprising a gasification zone and a water bath and producing a hot gaseous stream containing synthesis gas and flyash, and slag, in the gasification zone. The slag produced is allowed to discharge from the gasification zone into the water bath, the redox potential of the water bath being formulated or maintained at a level sufficient to inhibit sulfide presence or inclusion in the slag.

6 Claims, No Drawings

INHIBITION OF SULFIDE INCLUSION IN SLAG

BACKGROUND OF THE INVENTION

Partial combustion or gasification of coal involves reacting the coal at elevated temperatures and possibly elevated pressures with a limited volume of oxygen, the reaction preferably being carried out in the presence of additional agents such as steam, carbon dioxide, or various other materials. Gasification of coal produces a gas, known as synthesis gas, that contains mostly carbon monoxide and hydrogen. Also produced are varying quantities of other gases, such as carbon dioxide and methane, and various liquid and solid materials.

Many coals contain, in addition to carbon and hydrogen, varying quantities of inorganic incombustible material. This material ultimately becomes a particulate by-product of the process of oxidation, and, depending on characteristics such as density and size of the particular particle, and the reactor configuration and conditions, may undergo a rough separation in the reactor into particles respectively called "flyash" (lighter) and "slag" (denser). In a vertically disposed gasification zone or reactor, the flyash particles are removed overhead, while the denser materials collect as a molten slag, often including separated iron, in the hearth of the reactor. From the hearth of the reactor the slag is discharged downward through an outlet or orifice, referred to as a slag tap, into a water bath.

This slag, because it is derived from a "reducing" atmosphere, tends to be different in composition and properties from slag normally associated with combustion boilers where a fully oxidizing atmosphere is utilized. For example, the slag from processes for partial combustion of coal may contain elemental iron and sulfides, components not normally associated with boiler slag.

The slag may have undesirable properties insofar as its ultimate disposal is concerned. In particular, it may contain undesirable species such as arsenic, selenium, and the aforementioned sulfides, and, if the slag is to be utilized, or disposed of as land fill, it must be in a form which does not release such materials readily to the environment. The sulfides present are particularly troublesome since, upon contact with strongly acidic material, hydrogen sulfide will be evolved. Accordingly, the slag removed from the bottom of the water bath in partial combustion processes will normally undergo further processing before use or disposal. The invention addresses particularly the problem of the evolution of $H_2S$ from such slag.

SUMMARY OF THE INVENTION

Accordingly, in one embodiment, the invention relates to a process for the gasification of coal comprising partially combusting particulate coal in a gasification reactor comprising a gasification zone and a water bath and producing a hot gaseous stream containing synthesis gas and flyash, and slag, in the gasification zone, and allowing the slag produced to discharge from the gasification zone into the water bath, the redox potential (IUPAC 1953 Stockholm Convention) of the water bath being formulated or maintained at a level sufficient to inhibit sulfide presence or inclusion in the slag. In accordance with the invention, the gaseous stream is quenched and cooled and at least the bulk of the flyash is removed therefrom.

In a preferred embodiment, the redox potential is maintained at from −0.3 v to 1.2 v, preferably 0.0 v to 0.5 v. The redox potential of the water in the bath may be maintained at the levels mentioned, in a variety of ways, e.g., by the addition of a suitable oxidant. For example, oxygen may be added to the makeup water for the bath, or may be added to a recirculation line for the bath. The oxygen may be added as air or as pure or semi-pure oxygen. Alternatively, solid or dissolved additives may be employed to bring to or maintain the water bath's redox potential at the desired level. Suitable oxidants include alkali and alkaline earth persulfates and perchlorates; iron (III) salts, such as the chloride, bromide, and nitrate; alkali and alkaline earth sulfites and ferrates, peroxides, such as hydrogen peroxide, and chromates and permanganates. As those skilled in the art are aware, the oxygen or additives will be added in an effective amount, i.e., an amount sufficient to bring the redox potential to the desired range. The oxidant may be added on a continuous or intermittent basis, as needed.

It will be understood that the water bath, which may be derived from any suitable source of water, contains a variety of ionic species which will effect the amount of air, oxygen or other additives added to the bath. For example, various metal ions, such as iron and sodium ions, may be present in the bath. Those skilled in the art will recognize that the only significant requirement is that the concentrations or character of any extraneous components of the water do not interfere to any substantial extent with the desired modification or maintenance of the redox potential in the manner of the invention.

Although there is no desire to suggest a theory of the invention, it is believed that the control of the water bath at the redox range or levels mentioned allows the sulfur-containing species in the slag from the gasification reaction to be converted to soluble species which are then removed with the water, or sulfur which forms a passivating surface on the slag particles. Accordingly, an oxidant which is capable of inhibiting sulfide presence or inclusion in the slag refers to those compositions or compounds, or mixtures thereof, which possess sufficient oxidative capacity to inhibit formation of or convert insoluble sulfur containing species in the slag and provide sulfur present in a higher oxidized state, such as in a sulfate. It thus excludes compositions, such as strong acids, which would generate $H_2S$, and obviously, sulfides. As noted, an effective amount of the composition capable of inhibiting sulfides in the slag is employed. This amount, per given mass of slag, may be determined by analysis of the sulfur content of a sample of the slag on start-up or on introduction of a new coal. Preferably, sufficient oxidant composition to convert the sulfur species present, preferably on at least a stoichiometric basis, is employed, and normally, an excess of the composition will be employed.

DETAILED DESCRIPTION OF THE INVENTION

The partial combustion of coal to produce synthesis gas, which is essentially carbon monoxide and hydrogen, and particulate flyslag, is well known, and a survey of known processes is given in "Ullmanns Enzyklopadie Der Technischen Chemie", vol. 10 (1958), pp. 360–458. Several such processes for the preparation of hydrogen and carbon monoxide, flyslag-containing gases are currently being developed. Accordingly, details of the gasification process are related only insofar is as necessary for understanding of the present invention.

In general, the gasification is carried out by partially combusting the coal with a limited volume of oxygen at a temperature normally between 800° C and 2000° C, and preferably at a temperature between 1050° C and 2000° C. If a temperature of between 1050° C and 2000° C is employed, the product gas may contain very small amounts of gaseous side products such as tars, phenols and condensable hydrocarbons. Suitable coals include lignite, bituminous coal, sub-bituminous coal anthracite coal, and brown coal. Lignites and bituminous coals are preferred. In order to achieve a more rapid and complete gasification, initial pulverization of the coal is preferred. Particle size is preferably selected so that 70% of the solid coal feed can pass a 200 mesh sieve. The gasification is preferably carried out in the presence of oxygen and steam, the purity of the oxygen preferably being at least 90% by volume, nitrogen, carbon dioxide and argon being permissible as impurities. If the water content of the coal is too high, the coal should be dried before use. The atmosphere will be maintained reducing by the regulation of the weight ratio of the oxygen to moisture and ash free coal in the range of 0.6 to 1.0, preferably 0.8 to 0.9. The specific details of the equipment and procedures employed form no part of the invention, but those described in U.S. Pat. No. 4,350,103 and U.S. Pat. No. 4,458,607, both incorporated herein by reference, may be employed. Although, in general, it is preferred that the ratio between oxygen and steam be selected so that from 0.1 to 1.0 parts by volume of steam is present per part by volume of oxygen, the invention is applicable to processes having substantially different ratios of oxygen to steam. The oxygen used is preferably heated before being contacted with the coal, preferably to a temperature of from about 200° to about 500° C.

The details of the gasification reactor system form no part of the present invention, and suitable reactors are described in British Pat. No. 1501284 and U.S. Pat. No. 4,022,591. The high temperature at which the gasification is carried out is obtained by reacting the coal with oxygen and steam in a reactor at high velocity. A preferred linear velocity is from 10 to 100 meters per second, although higher or lower velocities may be employed. The pressure at which the gasification can be effected may vary between wide limits, preferably being from 1 to 200 bar. Residence times may vary widely; common residence times of from 0.2 to 20 seconds are described, with residence times of from 0.5 to 15 seconds being preferred.

After the starting materials have been converted, the reaction product gas, which comprises hydrogen, carbon monoxide, carbon dioxide, and steam, is removed from the reactor. Slag particles drop to the lower portion of the reactor, and thence into the water bath. The bath is maintained at, for example, an oxidation potential of 0.2v. The synthesis gas, which normally has a temperature between 1050° C and 1800° C, contains flyash, and is removed overhead. In order to permit removal of impurities from the gas, the reaction product stream should first be quenched and cooled. A variety of elaborate techniques have been developed for cooling the gaseous stream, the techniques in general being characterized by use of a quench gas and boiler in which steam is generated with the aid of the waste heat. Cyclones or other suitable techniques may be provided for removing particulate flyash solids from the gaseous stream. As a result of such treatment, a gas is obtained which contains hardly any solids, and which preferably has a temperature between 20° C and 40° C. Slag particles are removed from the bottom of the water bath. Slag particles removed from a slag bath maintained at redox levels according to the invention, on testing for evolution of $H_2S$, showed a substantially reduced emission level for this contaminant.

While the invention has been illustrated with particular apparatus, those skilled in the art will appreciate that, except where specified, other equivalent or analogous units may be employed. The term "zone", as employed in the specification and claims, includes, where suitable, the use of segmented equipment operated in series, or the division of one unit into multiple units to improve efficiency or overcome size constraints, etc. Parallel operation of units, is, of course, well within the scope of the invention.

What is claimed is:

1. A process for the gasification of coal comprising partially combusting particulate coal in a gasification reactor comprising a gasification zone and a water bath and producing a hot gaseous stream containing synthesis gas and flyash, and slag in the gasification zone, and allowing the slag produced to discharge from the reaction zone into the water bath, the redox potential of the water bath being maintained at level sufficient to inhibit sulfide presence or inclusion in the slag.

2. The process of claim 1 wherein the redox potential of the water bath is maintained at from −0.3 v to 1.2 v.

3. The process of claim 2 wherein the hot gaseous stream containing synthesis gas is quenched and cooled, flyash is removed from the synthesis gas, and the synthesis gas is recovered.

4. The process of claim 1 wherein an oxidant which is capable of inhibiting sulfide presence or inclusion in the slag is added to the bath in an amount effective to maintain the redox potential of the bath at from −0.3 v to 1.2 v.

5. The process of claim 4 wherein the oxidant is oxygen.

6. The process of claim 4 wherein the oxidant is selected from alkali and alkaline earth persulfates, alkali and alkaline earth perchlorates, iron (III) chloride, iron (III) bromide, iron (III) nitrate, alkali and alkaline earth sulfites, alkali and alkaline earth ferrates, and hydrogen peroxide.

* * * * *